US011648607B2

(12) United States Patent
Matsui et al.

(10) Patent No.: US 11,648,607 B2
(45) Date of Patent: May 16, 2023

(54) CONTINUOUS CASTING METHOD OF CAST SLAB

(71) Applicant: JFE STEEL CORPORATION, Tokyo (JP)

(72) Inventors: Akitoshi Matsui, Tokyo (JP); Shugo Morita, Tokyo (JP); Tatsuro Hayashida, Tokyo (JP); Yoshinari Hashimoto, Tokyo (JP); Ryosuke Masuda, Tokyo (JP); Taiga Koriyama, Tokyo (JP); Ryo Morishita, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 79 days.

(21) Appl. No.: 17/436,199

(22) PCT Filed: Feb. 28, 2020

(86) PCT No.: PCT/JP2020/008425
§ 371 (c)(1),
(2) Date: Sep. 3, 2021

(87) PCT Pub. No.: WO2020/179698
PCT Pub. Date: Sep. 10, 2020

(65) Prior Publication Data

US 2022/0126359 A1 Apr. 28, 2022

(30) Foreign Application Priority Data

Mar. 6, 2019 (JP) ..... JP2019-040116

(51) Int. Cl.
*B22D 11/20* (2006.01)
*B22D 11/115* (2006.01)

(52) U.S. Cl.
CPC ..... *B22D 11/20* (2013.01); *B22D 11/115* (2013.01)

(58) Field of Classification Search
CPC ..... B22D 11/20; B22D 11/115; B22D 11/202; B22D 11/204; B22D 11/205; B22D 11/207
See application file for complete search history.

(56) References Cited

U.S. PATENT DOCUMENTS

| | | | |
|---|---|---|---|
| 4,949,777 | A | 8/1990 | Itoyama et al. |
| 2002/0079083 | A1 | 6/2002 | Suzuki et al. |
| 2016/0332221 | A1 | 11/2016 | Kosugi et al. |

FOREIGN PATENT DOCUMENTS

| | | | |
|---|---|---|---|
| CN | 1428216 | A | 7/2003 |
| CN | 102355963 | A | 2/2012 |

(Continued)

OTHER PUBLICATIONS

Dec. 28, 2020 Office Action issued in Taiwanese Patent Application No. 109107055.

(Continued)

*Primary Examiner* — Kevin P Kerns
*Assistant Examiner* — Steven S Ha
(74) *Attorney, Agent, or Firm* — Oliff PLC

(57) ABSTRACT

A continuously casting method including arranging temperature measuring elements according to specified conditions, selecting as evaluation targets for temperatures of copper plates on a wide face of mold values measured by the temperature measuring elements arranged closer to a center in a width direction of a cast slab than short sides of the cast slab under continuous casting at levels of 50 mm or more lower in a slab withdrawal direction than a meniscus of a molten steel in a mold, and adjusting a casting condition such that a standard deviation of the values measured over the width direction of the copper plates on the wide face of mold at a same level in the slab withdrawal direction is 20° C. or lower.

4 Claims, 8 Drawing Sheets

(56) References Cited

FOREIGN PATENT DOCUMENTS

| | | | |
|---|---|---|---|
| CN | 104458040 | A | 3/2015 |
| CN | 103209784 | B | 9/2015 |
| EP | 2 409 795 | A1 | 1/2012 |
| JP | S56-095460 | A | 8/1981 |
| JP | H05-057412 | A | 3/1993 |
| JP | H10-305353 | A | 11/1998 |
| JP | 2001-287001 | A | 10/2001 |
| JP | 2002-035909 | A | 2/2002 |
| JP | 2003-010950 | A | 1/2003 |
| JP | 2003-181609 | A | 7/2003 |
| JP | 2009-214150 | A | 9/2009 |
| JP | 2009-241099 | A | 10/2009 |
| JP | 2017-060965 | A | 3/2017 |

OTHER PUBLICATIONS

Aug. 20, 2021 Office Action issued in Taiwanese Patent Application No. 109107055.
Nov. 26, 2021 Extended Search Report issued in European Patent Application No. 20765989.7.
Feb. 9, 2021 Office Action issued in Taiwanese Patent Application No. 109107055.
Apr. 5, 2022 Office Action issued in Japanese Patent Application No. 2021-504062.
Jul. 13, 2022 Office Action issued in Chinese Patent Application No. 202080019053.1.
Apr. 7, 2020 International Search Report issued in International Application No. PCT/JP2020/008425.
Dec. 14, 2022 Office Action issued in Korean Patent Application No. 10-2021-7028400.
Jan. 19, 2023 Office Action issued in Chinese Patent Application No. 202080019053.1.

CONTINUOUS CASTING METHOD OF CAST SLAB

TECHNICAL FIELD

This application relates to a continuous casting method of a cast slab. More specifically, the application relates to a continuous casting method of a cast slab in which the temperatures of copper plates on wide face of mold are measured during continuous casting to control a variation of the measured temperatures of the copper plates on wide face of mold to be within a predetermined range over the mold width direction.

BACKGROUND

In recent years, there has been a growing demand for improved productivity and a higher quality of slabs in continuous casting, and in order to improve the productivity of continuous casting machines, development of a technology for increasing a slab withdrawal rate and development of a technology for improving the quality of slabs have been advanced.

However, simply increasing the slab withdrawal rate results in non-uniform growth of a solidified shell in a mold, and cracks are generated in the surface of a portion of a slab at which the thickness of the solidified shell is small. In the worst case, breakout, which is a leakage of molten steel, may occur as a result of the portion in which cracks have been generated being torn, and the production with a continuous casting machine may be stopped for a long period of time. In addition, such a phenomenon is likely to occur in a type of steel to which a large amount of an alloy element, representative examples of which are silicon and manganese, is added for the purpose of improving the mechanical property of a steel product.

In order to overcome such a situation, a technology for controlling the flow of molten steel in a continuous casting mold has been developed, and for example, Patent Literature 1 proposes a method for applying a magnetic field to molten steel in a mold.

By applying a magnetic field to molten steel in a mold so as to control the flow of the molten steel, stabilization of productivity and quality to a certain degree can be achieved. However, even if a magnetic field is applied, it is difficult to completely control the flow of the molten steel in the mold because of, for example, unexpected operational fluctuations, and thus, there has been proposed a technology for controlling the operation by also using temperature measurement results that are obtained by temperature measuring elements embedded in mold copper plates.

For example, Patent Literature 2 proposes a method in which a plurality of temperature measuring elements are arranged in the width direction of the rear surfaces of mold copper plates so as to measure the temperature distribution in the mold copper plates in the width direction of a mold by using the temperature measuring elements and in which a surface defect in a slab is determined on the basis of the temperature distribution in the width direction of the mold.

Patent Literature 3 proposes a method in which the temperatures of copper plates on wide face of mold are measured by using temperature measuring elements, which are embedded in the rear surfaces of the copper plates on wide face of mold, while applying a travelling magnetic field that causes molten steel in a mold to swirl in the horizontal direction and in which a surface defect in a slab is determined on the basis of the measured temperatures of the mold copper plates. More specifically, in this method, measurement results obtained by temperature measuring elements that are symmetrically positioned using the axis of a mold space as the symmetry axis are compared, and when the ratio of one of the measured temperatures that is lower than the other to the other measured temperature, which is higher, is smaller than 0.85, it is determined that a defect has occurred in the surface of the slab.

CITATION LIST

Patent Literature

PTL 1: Japanese Unexamined Patent Application Publication No. 10-305353

PTL 2: Japanese Unexamined Patent Application Publication No. 2003-181609

PTL 3: Japanese Unexamined Patent Application Publication No. 2009-214150

SUMMARY

Technical Problem

However, the above-described technologies of the related art have the following problems.

In other words, in Patent Literature 2 and Patent Literature 3, a defect on the surface of a slab is determined by capturing changes in the temperatures of the mold copper plates with changes in the flow of the molten steel in the mold, and it is recommended to measure the temperatures of the mold copper plates in a region within 135 mm from the meniscus of the molten steel in the mold in a slab withdrawal direction.

However, as general examples of breakout generation mechanism, non-uniform inflow of mold powder and formation of a gap (called "air gap") between a mold and a solidified shell are known. That is to say, as a result of non-uniform inflow of mold powder, solidified shell is stuck to the mold in a portion in which the inflow amount of the mold powder is small, and this results in breakout. In addition, as a result of formation of an air gap, the amount of heat removed from the molten steel to the mold is locally reduced, and a portion having a small thickness is formed in the solidified shell. When this portion of the solidified shell is not capable of withstanding the ferrostatic pressure inside the solidified shell, cracks are generated in the portion, and breakout occurs. Non-uniform inflow of the mold powder also forms such a portion of the solidified shell having a small thickness, and this causes a breakout.

In order to detect such a portion of a solidified shell that has a locally small thickness, it is insufficient to only perform temperature measurement in a region within 135 mm from the meniscus of molten steel in a mold in a slab withdrawal direction, and the phenomenon cannot be sufficiently captured. In other words, in order to ensure the stability of a continuous casting machine, it is necessary to measure the temperature of a larger portion of each mold copper plate.

The disclosed embodiments have been made in view of the above situation, and it is an object of the disclosed embodiments to provide a continuous casting method of a cast slab, the method capable of measuring the temperatures of large portions of copper plates on wide face of mold during continuous casting of a cast slab and adjusting casting conditions in such a manner that variations in the measured temperatures of the copper plates on wide face of mold in the width direction of a mold are within a predetermined range so as to achieve both a high productivity of a continuous casting machine and manufacture of a high-quality slab.

Solution to Problem

The gist of the disclosed embodiments for solving the above problem is as follows.

[1] A continuous casting method of a cast slab in which temperature measuring elements are arranged in each of opposedly facing copper plates on wide face of mold of a mold for continuous casting and in which a steel cast slab is continuously cast while temperatures of the copper plates on wide face of mold are measured by using the temperature measuring elements. In the method, the temperature measuring elements are arranged such that temperature measurement points of the temperature measuring elements are positioned between a molten steel side surface of and a cooling-water slit of the copper plates on wide face of mold and such that the temperature measurement points are spaced apart from the molten steel side surface of the copper plates on wide face of mold by the same distance in a thickness direction of the copper plates. The temperature measurement points are arranged in a grid-like pattern in a region from a meniscus of a molten steel to a level 600 mm or more below the meniscus of a molten steel in a slab withdrawal direction at a pitch of 100 mm or smaller in the slab withdrawal direction and at a pitch of 150 mm or smaller in a width direction of the copper plates on wide face of mold. Values measured by the temperature measuring elements arranged closer to a center in a width direction of the cast slab than short sides of the cast slab under continuous casting at levels of 50 mm or more lower in the slab withdrawal direction than the meniscus of the molten steel in the mold are selected as evaluation targets for the temperatures of the copper plates on wide face of mold. A casting condition is adjusted such that a standard deviation of the values measured over the width direction of the copper plates on wide face of mold at a same level in the slab withdrawal direction is 20° C. or lower.

[2] In the continuous casting method of a cast slab described in [1], the casting condition is adjusted such that all the standard deviations of the values measured over the width direction of the copper plates on wide face of mold at each level in the slab withdrawal direction are 20° C. or lower.

[3] In the continuous casting method of a cast slab described in [1] or [2], the casting condition includes one, or two or more of three conditions that are the slab withdrawal rate, a magnetic flux density applied to the molten steel in the mold by an electromagnetic-field generating device, and a submergence depth of a submerged entry nozzle.

Advantageous Effects

In the disclosed embodiments, the temperatures of large portions of copper plates on wide face of mold in a slab withdrawal direction and in the width direction of the copper plates on wide face of mold are measured, and casting conditions are adjusted in such a manner that variations in the temperatures measured over the width direction of the copper plates on wide face of mold at the same level in the slab withdrawal direction are small. As a result, an operation that achieves both a high productivity of a continuous casting machine and a high quality of a cast slab can be performed.

DETAILED DESCRIPTION

Figure 1:
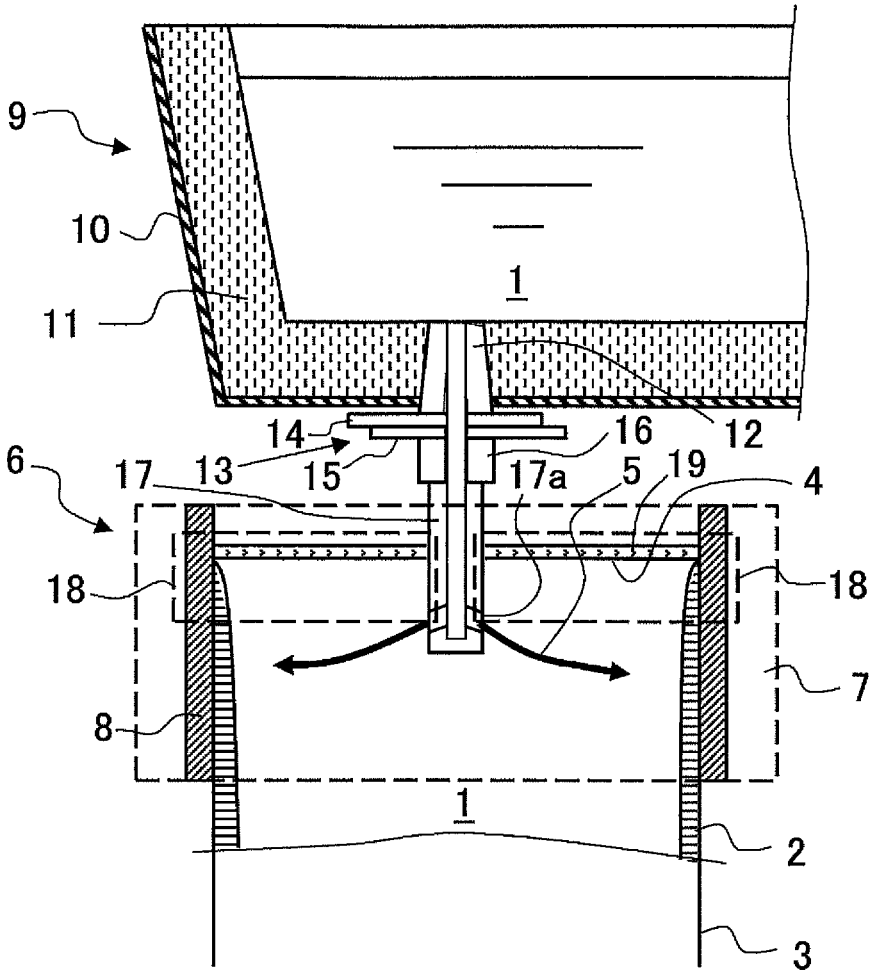
FIG. 1 is a schematic sectional view of a slab continuous casting machine suitable when a continuous casting method of a cast slab according to the disclosed embodiments is implemented.

The disclosed embodiments will be specifically described below with reference to the accompanying drawings. FIG. 1 is a schematic sectional view of a slab continuous casting machine suitable for implementing a continuous casting method of a cast slab according to the disclosed embodiments, in which a sectional front view of a continuous casting mold and a tundish is illustrated.

In FIG. 1, a tundish 9 is disposed at a predetermined position above a continuous casting mold 6 that includes opposedly facing copper plates 7 on wide face of mold, and opposedly facing copper plates 8 on narrow face of mold which are sandwiched between the copper plates 7 on wide face of mold. An upper nozzle 12 is disposed in a bottom portion of the tundish 9, and a sliding nozzle 13 that includes a fixing plate 14, a sliding plate 15, and a rectifying nozzle 16 is disposed to be in contact with the lower surface of the upper nozzle 12. In addition, a submerged entry nozzle 17 that has a pair of outlet holes 17*a* is disposed to be in contact with the lower surface of the sliding nozzle 13. In order to prevent alumina from adhering to the inner wall surface of the submerged entry nozzle 17, a noble gas, such as argon gas, or a non-oxidizing gas, such as nitrogen gas, is blown from the upper nozzle 12, the fixing plate 14, the submerged entry nozzle 17, and so forth onto molten steel 1 that is supplied to the continuous casting mold 6 from the tundish 9. The tundish 9 has an iron shell 10 as its outer shell, and a refractory material 11 is provided on the inner side of the iron shell 10.

Electromagnetic-field generating devices 18 are arranged on the rear surfaces of the copper plates 7 on wide face of mold in such a manner that the electromagnetic-field generating devices 18 face with each other to interpose the copper plates 7 on wide face of mold therebetween. Each of the electromagnetic-field generating devices 18 is connected to a power supply (not illustrated) by a wiring line and is configured such that a magnetic flux density applied by the electromagnetic-field generating device 18 and a travelling direction of a magnetic field can be controlled by the electrical power supplied from the power supply. Note that, in FIG. 1, when each of the copper plates 7 on wide face of mold is divided into left and right regions in the width direction thereof while the submerged entry nozzle 17 is serving as the boundary between these two regions, a total of four electromagnetic-field generating devices 18 are each disposed in one of the regions so as to face one of the other electromagnetic-field generating devices 18 with the copper plates 7 on wide face of mold interposed therebetween. However, each of the electromagnetic-field generating devices 18 is not limited to having the specifications illustrated in FIG. 1, and a device that is suitable for the characteristics of steel products to be manufactured may be suitably selected. Examples of such a device include a device that applies a direct-current magnetic field to molten steel so as to limit the flow of the molten steel and a device that applies an alternating-current magnetic field to molten steel so as to cause the molten steel to swirl or limit the flow of the molten steel in a given direction.

The molten steel 1 is teemed into the tundish 9 from a ladle (not illustrated). When the amount of the molten steel 1 in the tundish 9 reaches a predetermined amount, the sliding plate 15 is opened, and the molten steel 1 is poured into the continuous casting mold 6 from the tundish 9. The molten steel 1 is flowed into the internal space of the continuous casting mold 6 through the outlet holes 17*a* of the submerged entry nozzle 17 while forming jet flows 5 toward the copper plates 8 on narrow face of mold. The molten steel 1 flowed into the internal space of the continuous casting mold 6 comes into contact with the continuous casting mold 6 and is cooled. As a result, the solidified shell 2 is formed on a surface in contact with the continuous casting mold 6.

Once a predetermined amount of the molten steel 1 has been flowed into the internal space of the continuous casting mold 6, the outlet holes 17*a* are maintained submerged in the molten steel 1, and pinch rolls (not illustrated), which is disposed below the continuous casting mold 6, are driven so as to start withdrawal of a cast slab 3 that includes the solidified shell 2 as its outer shell and the unsolidified molten steel 1 therein. After the withdrawal has been started, the slab withdrawal rate is increased to a predetermined slab withdrawal rate while the meniscus of the molten steel 4 in the continuous casting mold is controlled to be maintained at a substantially fixed position. Mold powder 19 is added to the meniscus of the molten steel 4 in the mold. The mold powder 19 melts and provides an advantageous effect of preventing oxidation of the molten steel 1 and an advantageous effect as a lubricating material by flowing into a space between the solidified shell 2 and the continuous casting mold 6.

Regarding magnetic fields that are applied by the electromagnetic-field generating devices 18, (1) a method of applying magnetic fields that travel in opposite directions by using the electromagnetic-field generating devices 18, which opposedly face each other, and forming a swirling flow of the molten steel 1 in the horizontal direction on the meniscus of the molten steel 4 in the mold, that is, a method of forming a flow of the molten steel that swirls in the horizontal direction along a solidified shell interface, (2) a method of applying magnetic fields that travel in the same direction by using the electromagnetic-field generating devices 18, which opposedly face each other, and decelerating or accelerating the velocity of each of the jet flows 5, (3) a method of reducing the flow velocity of the molten steel 1 in the mold by applying a direct-current static magnetic field, or the like is used depending on the purpose.

The inventors examined a method of withdrawing a slab and the temperature distribution in the copper plates 7 on wide face of mold in the width direction of the copper plates on wide face of mold under various casting conditions in the operation of the slab continuous casting machine performed in the manner described above. In this case, thermocouples serving as temperature measuring elements were embedded in the opposedly facing copper plates 7 on wide face of mold in such a manner that each pair of the thermocouples face each other at approximately the same position.

Note that, although thermocouples are used as the temperature measuring elements in this case, the temperature measuring elements may be any elements as long as they can accurately measure the temperatures of the mold copper plates, and examples of such elements include optical fiber type sensors. In the case where the copper plates 7 on wide face of mold are each formed to have a flat surface as in a vertical-bending type slab continuous casting machine, when optical fibers are used, for example, the optical fibers may be inserted from the upper end surfaces of the copper plates 7 on wide face of mold in the slab withdrawal direction to be parallel to the surfaces of the mold long side copper plate 7 on the side on which the molten steel is present.

In addition, the installation positions of temperature measurement points of the temperature measuring elements (in the case of using thermocouples, the positions of ends of the thermocouples) in the thickness direction of the mold copper plates are set such that the distances of all the installed temperature measurement points in the thickness direction of the copper plates are the same as one another (each of the installed temperature measurement points is spaced apart from the molten steel side surface of the mold copper plate by the same distance) and such that each of the temperature measurement points is positioned between the molten steel side surface and cooling water slits (water channels through which cooling water for cooling the mold copper plates passes) of the mold long-side copper plate 7.

Figure 2:
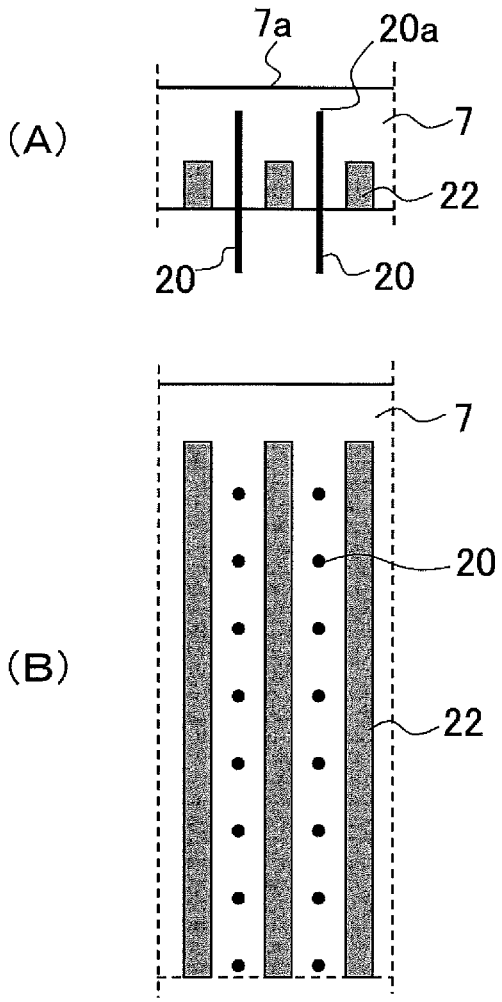
FIG. 2 is a schematic view illustrating a method of arranging thermocouples when the thermocouples are used as temperature measuring elements.

FIG. 2 is a schematic view illustrating a specific arrangement method when thermocouples are used as temperature measuring elements. FIG. 2A is a cross-sectional view of a portion of one of the copper plates 7 on wide face of mold when viewed from above in the vertical direction. FIG. 2B is a side view of a portion of one of the copper plates 7 on wide face of mold when viewed from the side on which a water chamber (a mold-cooling-water supply/drainage device) is provided.

In the case where thermocouples 20 are arranged as temperature measuring elements, as illustrated in FIG. 2, holes into which the thermocouples 20 are inserted are formed in portions of the rear surface of each of the copper plates 7 on wide face of mold, the portions not having cooling-water slits 22 formed therein, so as to be substantially perpendicular to the rear surface of the mold long-side copper plate 7, and the thermocouples 20 are inserted into these holes. The thermocouples 20 are arranged in such a manner that a temperature measurement point 20*a* of each of the thermocouples 20 (an end of each of the thermocouples) is positioned between a molten steel side surface 7*a* and the cooling-water slits 22 of the mold long-side copper plate 7.

In the case (not illustrated) where optical fiber sensors (FBG sensors) are arranged as temperature measuring elements, holes are formed between the molten steel side surfaces 7*a* of the copper plates 7 on wide face of mold and the cooling-water slits 22 so as to be parallel to the molten-steel-side surfaces 7*a* of the copper plates 7 on wide face of mold, and the optical fiber sensors are inserted into these holes. The temperature measurement points are located at positions similar to those in the case where thermocouples are used as the temperature measuring elements, and the positions are indicated by black dots (•) in FIG. 2.

It is preferable that the temperature measurement point of each of the temperature measuring elements be positioned between the molten steel side surface and the cooling-water slits 22 of the mold long-side copper plate 7 and be present within a distance range of 4 mm to 20 mm from the molten steel side surface 7*a* of the mold long-side copper plate 7. When the distance range falls below 4 mm, cracks generated due to a heat load applied to the mold copper plates may extend to the temperature measurement points and damage the temperature measuring elements. When the distance range exceeds 20 mm, this is not preferable because the temperature measurement responsivity deteriorates.

Figure 3:
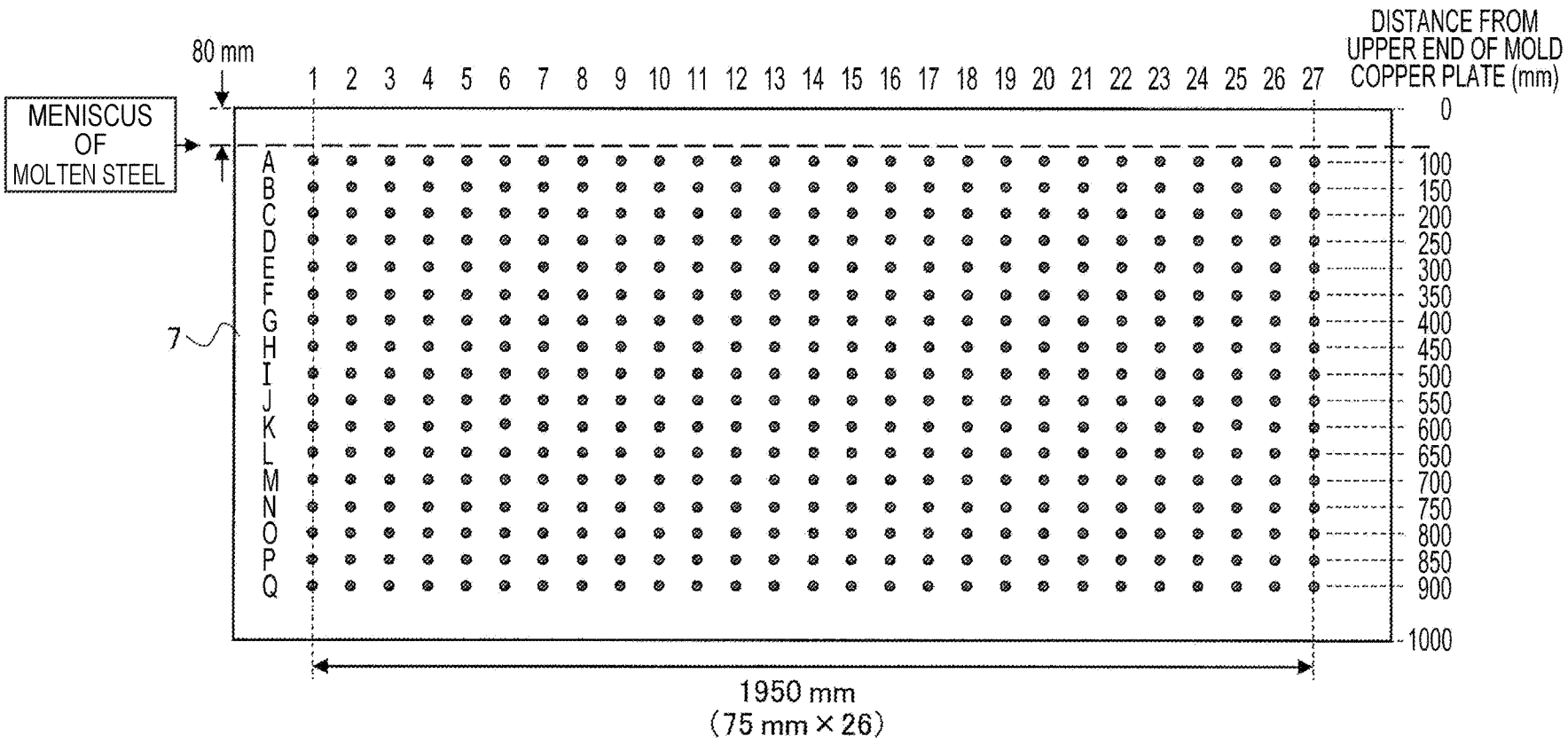
FIG. 3 is a schematic view illustrating the positions of thermocouples arranged in copper plates on wide face of mold when a method of withdrawing a slab and the temperature distribution in the copper plates on wide face of mold in the width direction of the copper plates on wide face of mold are examined.

FIG. 3 illustrates the positions at which the thermocouples are disposed in one of the copper plates 7 on wide face of mold. The positions at which the thermocouples are disposed are indicated by black dots (•) in FIG. 3. As illustrated in FIG. 3, in the slab withdrawal direction, the thermocouples were arranged to form a total of 17 rows A to Q at a pitch of 50 mm starting from positions 100 mm away from the upper end of the mold long-side copper plate 7. In addition, in the width direction of the mold long-side copper plate 7, the thermocouples were arranged to form a total of 27 columns 1 to 27 at a pitch of 75 mm, and the thermocouples were arranged in a grid-like pattern in the slab withdrawal direction and in the width direction of the mold long-side copper plate 7.

As described above, by arranging the thermocouples in a grid-like pattern in substantially the entire area of each of the copper plates 7 on wide face of mold, the temperature distribution in the entire copper plates 7 on wide face of mold can be measured. Note that, in FIG. 3, although the position of the meniscus of the molten steel 4 is 80 mm away from the upper end of the mold long-side copper plate 7, the position of the meniscus of the molten steel 4 can be changed within a range of 80±30 mm without affecting the continuous casting operation.

The temperature distribution in each of the copper plates on wide face of mold was measured while the cast slab 3 is continuously cast by using the above-described continuous casting mold 6. The obtained temperature distribution was compared with the operating state during the continuous casting.

First, the inventors conducted examinations to determine a temperature measurement range and a temperature measurement pitch in and at which non-uniform inflow of the mold powder and formation of an air gap can be detected without fail. More specifically, data items regarding temperatures measured at a total of 459 points (=17×27), which are "A-1" to "Q-27", obtained under various casting conditions were analyzed, with some omission of these data items.

If non-uniform inflow of the mold powder occurs, in the space between the continuous casting mold 6 and the solidified shell 2, there will be a region in which the inflow amount of the mold powder is locally small. In this region, the thermal resistance of the mold powder is small, and thus, the temperature measured by one of the thermocouples that measures the temperature of one of the copper plates on wide face of mold in the above region is likely to be higher than the temperature measured by another one of the thermocouples that is adjacent to the one thermocouple in the width direction of the mold. In contrast, if an air gap is generated between the continuous casting mold 6 and the solidified shell 2, the distance between the solidified shell 2 and the continuous casting mold 6 increases, and thus, the temperature measured by one of the thermocouples that measures the temperature of one of the copper plates on wide face of mold at the portion where the air gap has been generated is likely to be lower than the temperature measured by another one of the thermocouples that is adjacent to the one thermocouple in the width direction of the mold.

As a result of conducting analysis on the basis of such temperature measurement results, it was discovered that the measurement range in which non-uniform inflow of the mold powder and formation of an air gap may be detected without fail was required to satisfy the following conditions.

1. A region of at least 600 mm or more from the meniscus of the molten steel in the mold in the slab withdrawal direction needs to be measured.

2. Measurement needs to be performed at a pitch of 100 mm or less in the slab withdrawal direction.

3. Measurement needs to be performed at a pitch of 150 mm or less in the width direction of the copper plates on wide face of mold.

It was found that, when measurement was performed in a region smaller than the above region and at a pitch greater than the above pitch, it is likely to fail to detect a local temperature change due to non-uniform inflow of the mold powder or formation of an air gap.

Next, the inventors repeatedly conducted extensive studies on an index that indicates local variations in the temperatures of the copper plates on wide face of mold. The studies led to the conclusion that it was most preferable to use the standard deviation of temperatures measured in the width direction of the copper plates on wide face of mold at the same position in the slab withdrawal direction. The inventors also found that, in this case, it was important for stable control of the continuous casting operation not to include the values measured by the thermocouples on the row higher than the level 50 mm below the meniscus of the molten steel 4 in the continuous casting mold in the evaluation because such measured values were greatly affected by fluctuations in the position of the meniscus of the molten steel. In other words, it was found that the values measured by the temperature measuring elements arranged at positions that are spaced downward away from the meniscus of the molten steel 4 in the continuous casting mold by 50 mm or more in the slab withdrawal direction needed to be evaluation targets. In addition, it is obvious that the values measured at positions that are closer to the center of the cast slab, which is undergoing continuous casting, than the positions of the short sides of the cast slab in the width direction of the cast slab are the evaluation targets. The temperatures of the copper plates on wide face of mold are low at the positions of the short sides of the cast slab, which is undergoing continuous casting, and at positions outside the positions of the short sides, and the values measured by the thermocouples included in the columns located at these positions are not the evaluation targets.

In the above-mentioned evaluation target range, comparative verifications were performed under various casting conditions. As a result, it was discovered that, by performing the operation in such a manner that the standard deviation of the temperature measurement points in the width direction of the copper plates on wide face of mold at the same position in the slab withdrawal direction was 20° C. or lower, the stability of the continuous casting operation can be ensured, and a high productivity of the continuous casting machine and a high quality of the cast slab can be both achieved. Preferably, the operation may be performed in such a manner that all the standard deviations of the temperature measurement points in the width direction of the copper plates on wide face of mold at the same position in the slab withdrawal direction are 20° C. or lower.

According to the simulation conducted by the inventors, if the casting conditions are changed even when the standard deviation does not exceed 20° C. (for example, if the casting conditions are changed when the standard deviation exceeds 15° C.), it will be necessary to perform excessive intervention in the operation by, for example, constantly and extremely reducing the slab withdrawal rate in order to control the standard deviation to be within a predetermined range, and there is a concern that this may actually cause deterioration of the productivity. In other words, in the case where the standard deviation does not exceed 20° C., it is desirable not to change the casting conditions.

In contrast, in the case where the operation is performed with a standard deviation exceeding 20° C. (including the case where the casting conditions are changed when the standard deviation exceeds, for example, 30° C.), since the casting conditions are not changed even if a local thickness reduction occurs in a solidified shell, this state cannot be recovered and is likely to result in surface cracking in a cast slab or breakout, and in addition, deterioration of the quality of steel products is likely to be caused. In other words, in the case where the standard deviation exceeds 20° C., it is desirable to suitably change the casting conditions.

A method for controlling a standard deviation to be below 20° C. will now be described.

As a result of various experiments performed by the inventors, it was found that three types of factors including the slab withdrawal rate, the magnetic flux density of each of the electromagnetic-field generating devices 18, and a submergence depth of the submerged entry nozzle 17 were effective in controlling the standard deviation. Here, the submergence depth of the submerged entry nozzle 17 refers to the distance from the meniscus of the molten steel 4 to the upper ends of outlet holes 17*a*.

Among these factors, an operation of changing the magnetic flux density (increasing the magnetic flux density) of each of the electromagnetic-field generating devices 18 is most preferable because it does not easily affect the productivity and the operation of the continuous casting machine. The length of time over which the submerged entry nozzle 17 can be used is set for each submergence depth from the standpoint of protecting a refractory material from damage. Although the submerged entry nozzle 17 is used under such limiting conditions, changing the submergence depth of the submerged entry nozzle 17 (increasing the submergence depth) is also effective. In addition, regarding changes in the slab withdrawal rate (decrease in the slab withdrawal rate), it is desirable that the slab withdrawal rate be maintained as high as possible in order to maintain the high productivity. However, when breakout occurs, the operation of the continuous casting machine is stopped, and it takes a long time to recover, and thus, it is also effective to perform control for reducing the slab withdrawal rate before such a situation occurs.

Figure 4:
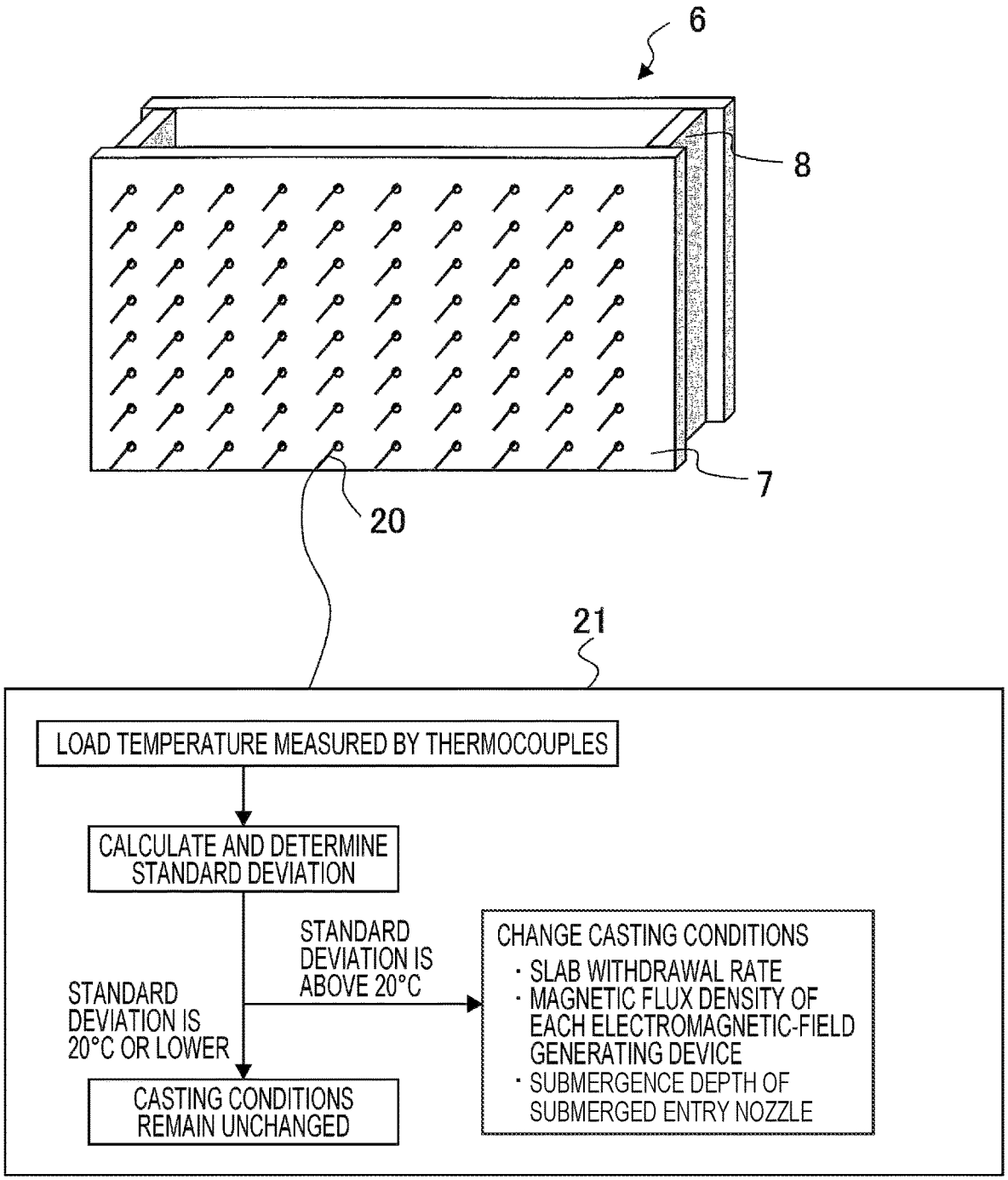
FIG. 4 is a schematic diagram illustrating a continuous casting mold in which thermocouples are embedded and an arithmetic unit for performing determination and control using a standard deviation, the mold and the arithmetic unit being used in the practice of the disclosed embodiments.

FIG. 4 is a schematic diagram illustrating the continuous casting mold 6 in which the thermocouples 20 are embedded and an arithmetic unit 21 for performing determination and control using a standard deviation, the continuous casting mold 6 and the arithmetic unit 21 being used in the practice of the disclosed embodiments. The thermocouples 20 are embedded in the continuous casting mold 6 at the above-mentioned appropriate positions. The data regarding the temperatures of the copper plates on wide face of mold measured by the thermocouples 20 is loaded by the arithmetic unit 21, and a standard deviation analysis of measured temperatures in the width direction of the copper plates on wide face of mold at the same position in the slab withdrawal direction is performed by using general-purpose statistical analysis software.

When the standard deviations in all the rows are 20° C. or lower, the continuous casting operation is continued without changing the casting conditions. When there is a row in which the standard deviation exceeds 20° C., it is preferable that the standard deviations in all the rows be controlled to be 20° C. or lower by adjusting any one of or any two or more of the magnetic flux density of each of the electromagnetic-field generating devices 18, the submergence depth of the submerged entry nozzle 17, and the slab withdrawal rate.

The cast slab that has undergone the continuous casting is transferred to a rolling process, which is the next process. Here, a cast slab with the standard deviation of 20° C. or lower is transferred to the rolling process, without performing a surface inspection of the cast slab. In contrast, a cast slab with the standard deviation exceeding 20° C. is subjected to, for example, a surface inspection of the cast slab, and if there are flaws such as cracks on the surface of the cast slab, the flaws on the surface are removed by a surface grinding treatment using a scarfer, a grinder, or the like, after which the cast slab is transferred to the rolling process. As a result, the quality of the end product is improved.

As described above, in the disclosed embodiments, the temperatures of large portions of the copper plates 7 on wide face of mold in the slab withdrawal direction and in the width direction of the copper plates 7 on wide face of mold are measured, and the casting conditions are adjusted in such a manner that variations in the measured temperatures in the width direction of the copper plates 7 on wide face of mold at the same position in the slab withdrawal direction are small. As a result, the operation that achieves both a high productivity of the continuous casting machine and a high quality of the cast slab can be performed.

Note that, in the disclosed embodiments, the standard deviation that is to be controlled is a standard deviation of variations with respect to space in the temperature of a copper plate at a given time (measured temperatures in the width direction of the long-side copper plates at the same position in a slab withdrawal direction), and the standard deviation of variations with respect to time is not to be controlled.

EXAMPLES

Aluminum killed molten steel was continuously cast by using a slab continuous casting machine having two strands (hereinafter referred to as "strand A" and "strand B"). A slab continuous casting machine having two strands uses molten steel having the same composition, and thus, a comparison can be performed under substantially similar operating conditions.

Figure 5:
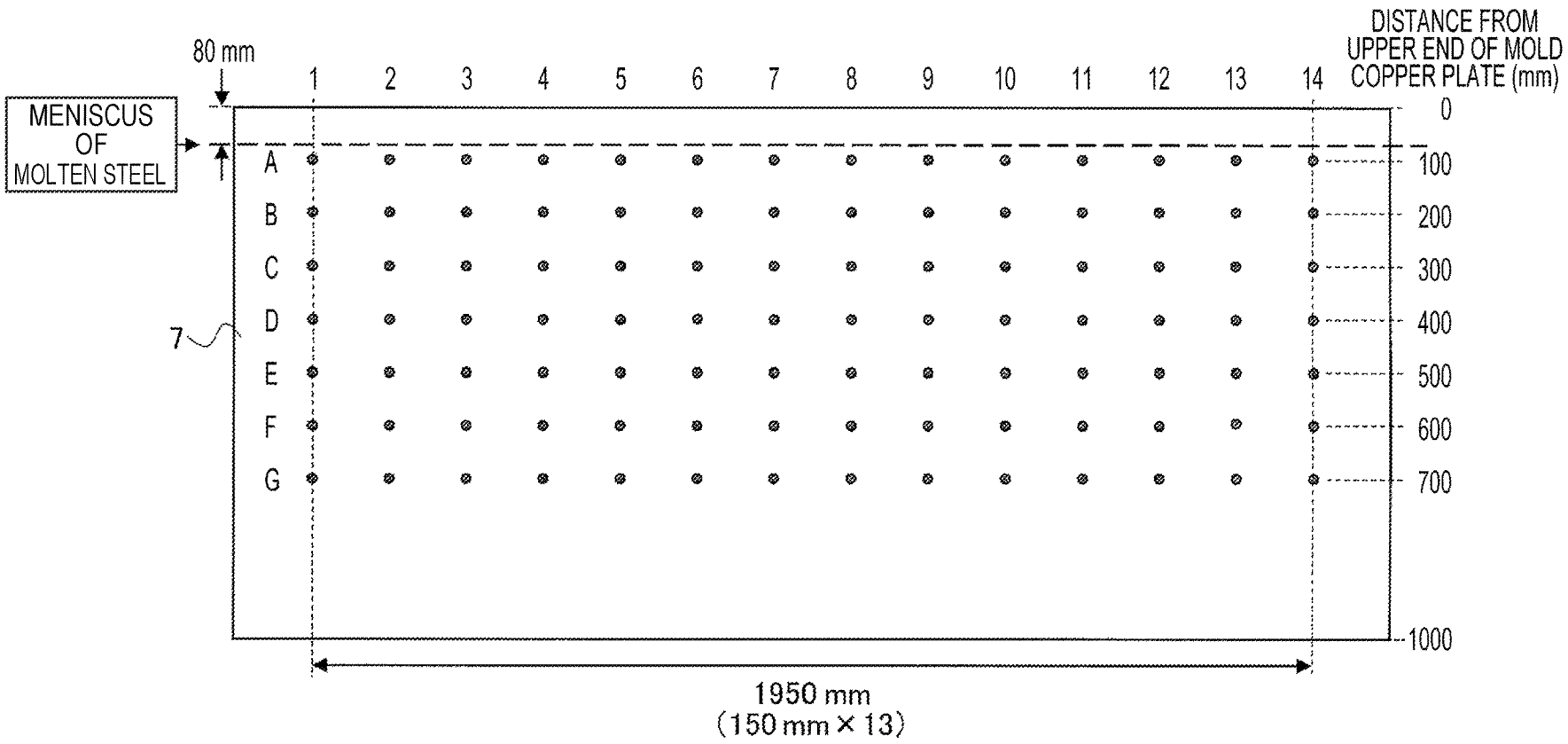
FIG. 5 is a schematic view illustrating the rear surface of copper plates on wide face of mold of a continuous casting mold mounted on a strand A in an embodiment.

The strand A was equipped with the continuous casting mold illustrated in FIG. 5 including copper plates on wide face of mold having thermocouples embedded in the rear surfaces thereof and the arithmetic unit illustrated in FIG. 4

(an example of the disclosed embodiments). Note that FIG. 5 is a schematic diagram illustrating the rear surface of one of the copper plates on wide face of mold, and the positions at which the thermocouples are disposed are indicated by black dots (•) in FIG. 5. As illustrated in FIG. 5, the thermocouples were arranged in a grid-like pattern such that, in the slab withdrawal direction, the thermocouples were arranged so as to form a total of 7 rows A to G at a pitch of 100 mm starting from positions 100 mm away from the upper end of each of the copper plates 7 on wide face of mold and such that, in the width direction of the mold long-side copper plate 7, the thermocouples were arranged to form a total of 14 columns 1 to 14 at a pitch of 150 mm.

Figure 6:
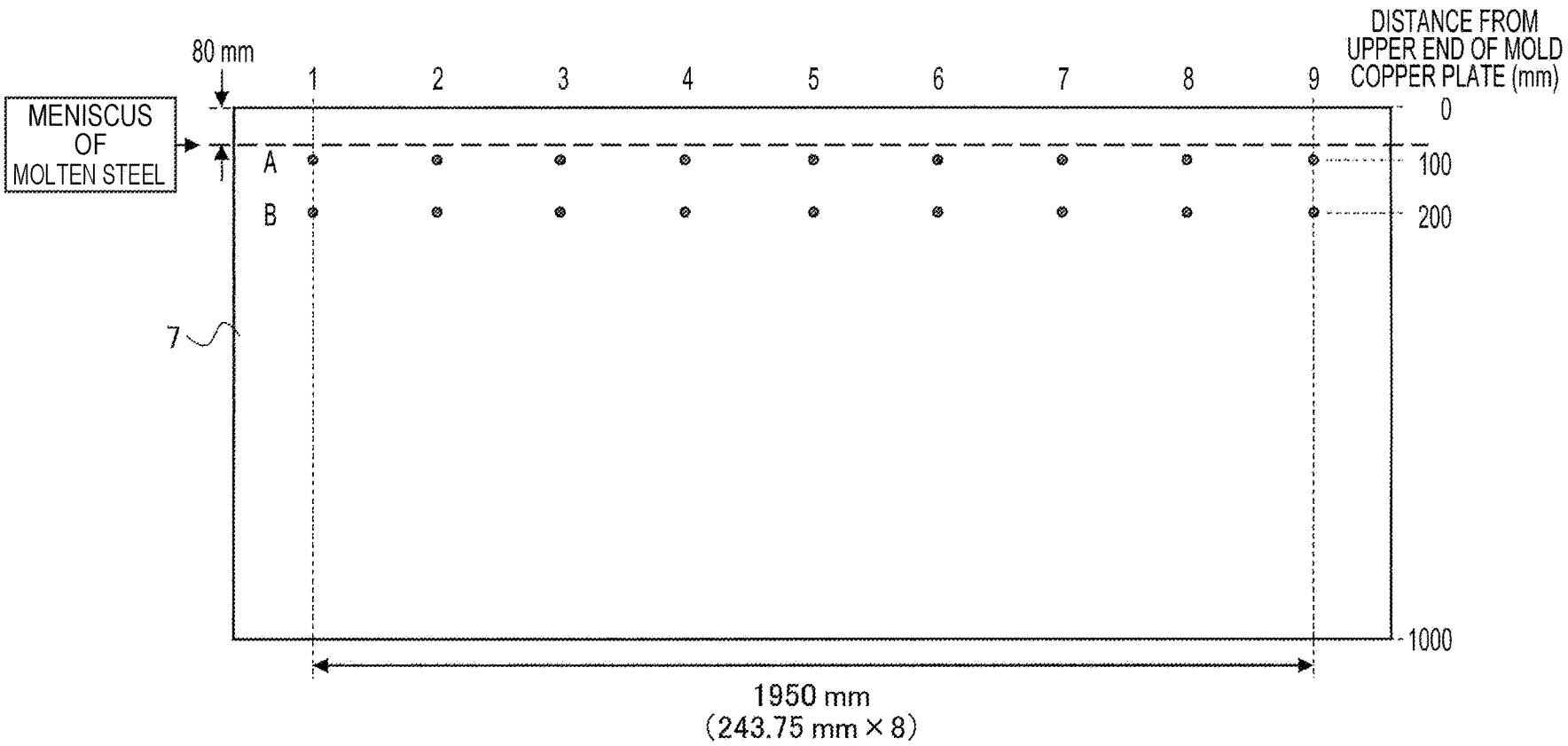
FIG. 6 is a schematic view illustrating the rear surface of copper plates on wide face of mold of a continuous casting mold mounted on a strand B in the embodiment.

As a comparative example, the strand B was equipped with a continuous casting mold including copper plates on wide face of mold having thermocouples embedded in the rear surfaces thereof as illustrated in FIG. 6. Note that FIG. 6 is a schematic diagram illustrating the rear surface of one of the copper plates on wide face of mold, and the positions at which the thermocouples are disposed are indicated by black dots (•) in FIG. 6. As illustrated in FIG. 6, in the slab withdrawal direction, the thermocouples were arranged at a level 100 mm below the upper end of the copper plates 7 on wide face of mold to form a row and at a level 200 mm below the upper end of the copper plates 7 on wide face of mold to form another row, at a pitch of 243.75 mm in the width direction of the mold long-side copper plate to form a total of 9 columns 1 to 9.

The continuous casting was performed under conditions of a thickness of the cast slab of 220 mm to 300 mm, a width of the cast slab of 1,000 mm to 2,100 mm, and a molten steel casting quantity of 3.0 tons/min to 7.5 tons/min. The flow angle of each outlet hole of a submerged entry nozzle was set to 15 degrees or more and 45 degrees or less, and the submergence depth (the distance from the meniscus of molten steel in a mold to the upper end of each outlet hole) was basically set to 80 mm and was changed within a range of 80±20 mm. In order to prevent alumina from adhering to the inner wall of the submerged entry nozzle, argon gas was blown through an upper nozzle into the molten steel flowing down in the submerged entry nozzle. In addition, travelling magnetic fields in opposite directions were applied along the copper plates on wide face of mold facing each other by the electromagnetic-field generating devices so as to cause the molten steel in the mold to form a flow that swirls in the horizontal direction along a solidified shell interface.

In the strand A, the temperatures measured over the width direction of the copper plates on wide face of mold on the columns 1 to 14 at each level of the rows B to G in the slab withdrawal direction, were taken in at one second interval using the arithmetic unit illustrated in FIG. 4, so as to analyze the standard deviation. In the case where some of the standard deviations of the temperatures measured at the temperature measurement points in all the rows exceed 20° C., any one of or any two or more of the additional current of each of the electromagnetic-field generating devices, the submergence depth of the submerged entry nozzle, and the slab withdrawal rate were adjusted such that each standard deviation is 20° C. or lower, and the standard deviations in all the rows were controlled to be 20° C. or lower. In contrast, in the strand B, a continuous casting operation was performed on the basis of preset casting conditions. Table 1 illustrates the test results.

TABLE 1

| | Example | Comparative Example |
|---|---|---|
| Strand Classification | Strand A | Strand B |
| Number of Thermocouples | 98 (7 Rows × 14 Columns, A to G) | 18 (2 Rows × 9 Columns, A and B) |
| Calculation Control of Standard Deviation | Yes | No |
| Operation Result | Removed after casting 3,425 charges with the same mold copper plates. The copper plates reached the end of their service lives. | At the 730th charges, breakout occurred during continuous casting of medium carbon steel with C = 0.12% by mass at a slab withdrawal rate of 1.4 m/min. |

In the case of the strand A, after the continuous casting mold has been installed, and 3,425 charges have been continuous cast, the continuous casting mold was removed on the basis of a mold exchange standard. In other words, in the strand A, the copper plates on wide face of mold reached the end of their service lives, and the continuous casting operation was performed without any trouble. In contrast, in the case of the strand B, after the continuous casting mold has been installed, at the 730th charges, breakout occurred during the period when continuous casting of medium carbon steel having a carbon content of 0.12% by mass was performed at a slab withdrawal rate of 1.4 m/min, and the mold was replaced.

In the strand B, as a result of detailed observation of the cast slab in which the breakout had occurred, the solidified shell having a small thickness was observed at the portion where the breakout occurred. When continuous casting of a similar type of steel was performed by using the strand A, there was a case where the standard deviation of the temperatures measured by the thermocouples exceeded 20° C., and the standard deviation was controlled to be 20° C. or lower by adjusting, with the control logic of the arithmetic unit, any one of or any two or more of the additional current of each of the electromagnetic-field generating devices, the submergence depth of the submerged entry nozzle, and the slab withdrawal rate, and breakout did not occur.

Figure 7:
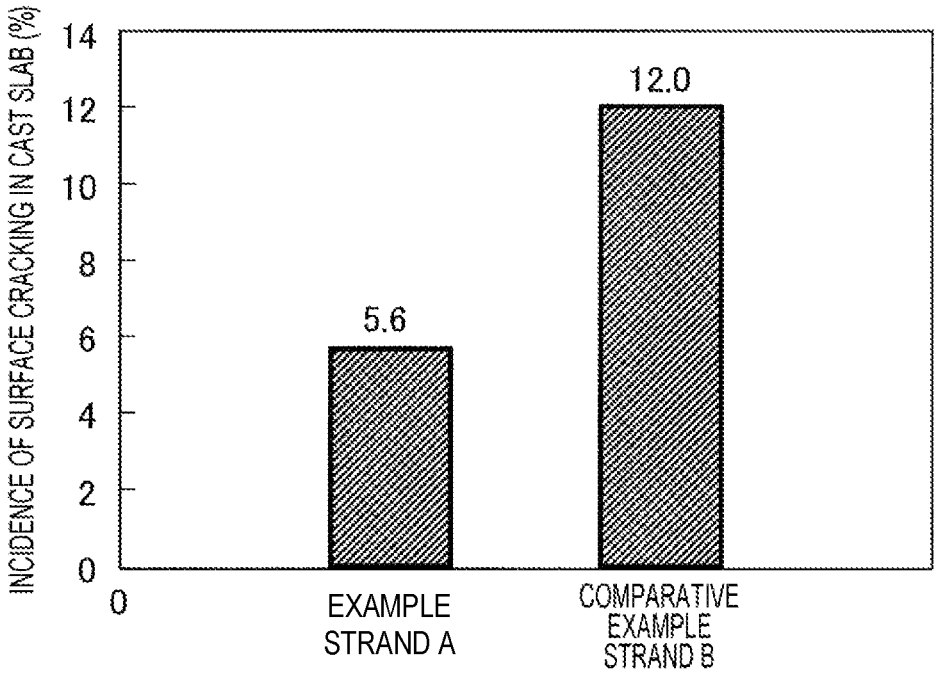
FIG. 7 is a graph illustrating results of examination of the incidence of surface cracking in cast slabs.

The qualities of the manufactured cast slabs were compared. The 125 cast slabs that were continuously cast under substantially the same casting conditions were extracted from each of the strand A and the strand B, and the surfaces of the cast slabs were inspected to check whether surface cracking had occurred. FIG. 7 illustrates results of examination of the incidence of surface cracking in the cast slabs. The incidence of surface cracking in the cast slabs is a numerical value (percentage) obtained by dividing the number of cast slabs having at least one portion in which surface cracking occurred by 125, which is the number of inspected cast slabs.

In the case of the strand B, the incidence of surface cracking was 12.0%, whereas in the case of the strand A, the incidence of surface cracking was reduced to 5.6%. In the disclosed embodiments, the casting conditions are adjusted so as to prevent a local thickness reduction from occurring in a solidified shell, and thus, it is assumed that surface cracking is less likely to occur in a cast slab and that a high-quality cast slab can be manufactured.

Figure 8:
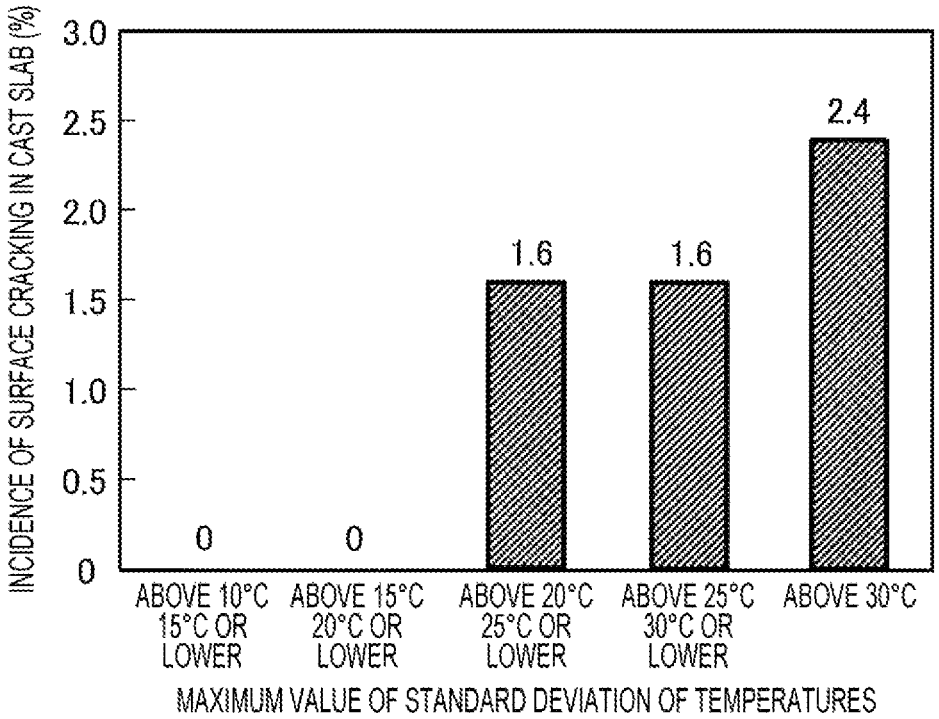
FIG. 8 is a graph illustrating the relationship between a maximum value of a standard deviation and the incidence of surface cracking.

In addition, for the slabs manufactured by using the strand A, the relationship between a maximum value of a standard deviation within the period of time over which each slab stayed in the mold and the incidence of surface cracking was examined. The examination results are illustrated in FIG. 8. Surface cracking was not observed in the cast slab in which the maximum value of the standard deviation was controlled to be 20° C. or lower, and in contrast, surface cracking was observed in some portions of the cast slab in which the maximum value of the standard deviation exceeded 20° C.

The yields of end products were compared. Cast slabs manufactured by using the strand B were transferred to the rolling process without being subjected to any treatment including a surface treatment using a scarfer or a grinder, and end products were obtained by performing hot rolling, cold rolling, or the like on the cast slabs. In contrast, regarding cast slabs manufactured by using the strand A, the cast slab with a standard deviation of 20° C. or lower were not subjected to any treatment. The surface of the cast slab with a standard deviation higher than 20° C., was visually observed for flaws, and then, the cast slab was transferred to the next process after removing the flaws by using a scarfer or a grinder. After that, end products were obtained by performing hot rolling, cold rolling, or the like on the cast slabs. For a portion having a defect at an end product stage, the defective portion was subjected to a treatment or was cut off, and the product yield was evaluated. Note that the product yield was evaluated as a numerical value obtained by dividing the mass of the products that were able to be shipped as products by the mass of the cast slabs.

Figure 9:
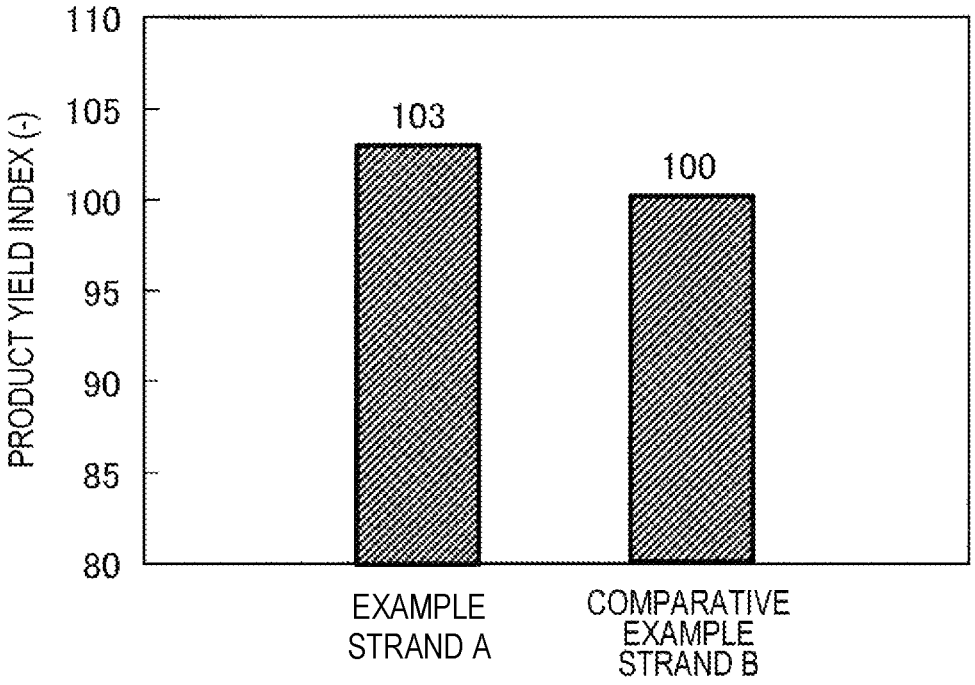
FIG. 9 is a graph illustrating results of examination of product yields.

Results of examination of the product yields are illustrated in FIG. 9. When the yield index of products manufactured by using cast slabs formed by the strand B, which was the comparative example, was 100, the yield index of products manufactured by using cast slabs formed by the strand A, which was an example of the disclosed embodiments, was 103 showing 3% of improvement in the product yield. This is because, in the example of the disclosed embodiments, surface flaws can be removed at a cast slab stage by using a determination system based on a standard deviation, and thus, a loss such as a cut-off portion at a product stage was reduced.

As described above, efficient and stable manufacture of a cast slab having a favorable quality is achieved by the continuous casting method of a cast slab according to the disclosed embodiments.

The invention claimed is:

1. A continuous casting method of a cast slab in which temperature measuring elements are arranged in each of oppositely facing copper plates on a wide face of mold of a mold for continuous casting and in which a steel cast slab is continuously cast while temperatures of the copper plates on the wide face of mold are measured by using the temperature measuring elements, the method comprising:

arranging the temperature measuring elements such that temperature measurement points of the temperature measuring elements are positioned between a molten steel side surface and a cooling-water slit of the copper plates on the wide face of mold and such that the temperature measurement points are spaced apart from the molten steel side surface of the copper plates on the wide face of mold by a same distance in a thickness direction of the copper plates;

arranging the temperature measurement points in a grid-like pattern in a region from a meniscus of a molten steel to a level 600 mm or more below the meniscus of the molten steel in a slab withdrawal direction at a pitch of 100 mm or smaller in the slab withdrawal direction and at a pitch of 150 mm or smaller in a width direction of the copper plates on the wide face of mold, selecting as evaluation targets for the temperatures of the copper plates on the wide face of mold values measured by the temperature measuring elements arranged closer to a center in a width direction of the cast slab than short sides of the cast slab under the continuous casting at levels of 50 mm or more lower in the slab withdrawal direction than the meniscus of the molten steel in the mold; and adjusting a casting condition such that a standard deviation of the values measured over the width direction of the copper plates on the wide face of mold at a same level in the slab withdrawal direction is 20° C. or lower.

2. The continuous casting method of a cast slab according to claim 1, wherein the casting condition is adjusted such that all the standard deviations of the values measured over the width direction of the copper plates on the wide face of mold at each level in the slab withdrawal direction are 20° C. or lower.

3. The continuous casting method of a cast slab according to claim 1, wherein the casting condition includes at least one condition selected from the group consisting of slab withdrawal rate, a magnetic flux density applied to the molten steel in the mold by an electromagnetic-field generating device, and a submergence depth of a submerged entry nozzle.

4. The continuous casting method of a cast slab according to claim 2, wherein the casting condition includes at least one condition selected from the group consisting of slab withdrawal rate, a magnetic flux density applied to the molten steel in the mold by an electromagnetic-field generating device, and a submergence depth of a submerged entry nozzle.

* * * * *